US005927120A

United States Patent [19]

Marando

[11] Patent Number: 5,927,120

[45] Date of Patent: Jul. 27, 1999

[54] APPARATUS FOR PERFORMING A HYDROFORMING OPERATION

[75] Inventor: Richard A. Marando, Mohrsville, Pa.

[73] Assignee: Dana Corporation, Toledo, Ohio

[21] Appl. No.: 08/903,514

[22] Filed: Jul. 30, 1997

[51] Int. Cl.[6] ..... B21D 26/02

[52] U.S. Cl. ..... 72/61; 72/58; 72/63

[58] Field of Search ..... 72/57, 58, 60, 72/61, 63

[56] References Cited

U.S. PATENT DOCUMENTS

| | | | |
|---|---|---|---|
| 1,041,406 | 10/1912 | Bauroth . | |
| 1,234,586 | 7/1917 | Wacker . | |
| 2,344,779 | 3/1944 | Kolderman et al. . | |
| 3,120,205 | 2/1964 | Pfeiffer et al. | 72/63 |
| 3,564,886 | 2/1971 | Nakamura . | |
| 3,971,243 | 7/1976 | Jones | 72/63 |
| 4,163,378 | 8/1979 | Hellgren | 72/63 |
| 4,319,471 | 3/1982 | Benteler et al. . | |
| 4,418,556 | 12/1983 | Galle et al. . | |
| 4,676,086 | 6/1987 | Hellgren | 72/63 |
| 4,751,835 | 6/1988 | Galaniuk et al. . | |
| 5,829,137 | 11/1998 | Grassi | 72/63 |

*Primary Examiner*—David Jones

*Attorney, Agent, or Firm*—MacMillan, Sobanski & Todd, LLC

[57] ABSTRACT

A hydroforming apparatus capable of deforming relatively large and thick-walled workpieces, yet which is relatively small, simple, and inexpensive in construction and operation, includes a pressure vessel that is disposed within a frame. The pressure vessel includes upper and lower vessel members that support respective die sections therein. When the upper and lower vessel members are moved adjacent to one another, the die sections cooperate to define a die cavity in which a workpiece to be hydroformed is disposed. An inflatable bladder is disposed between one or both of the die sections and the associated upper and lower vessel members. During the hydroforming operation, pressurized fluid is introduced within the workpiece so as to expand it outwardly into conformance with the die cavity defined by the die sections. At the same time, pressurized fluid is introduced into the inflatable bladder, causing it to expand between the die sections and the associated upper and lower vessel members. The inflatable bladder allows for limited expansion of the upper and lower vessel members while preventing relative movement between the die sections. As a result, the size, complexity, and cost of the hydroforming apparatus can be maintained at a minimum, while facilitating the hydroforming of relatively large and thick-walled workpieces, such as vehicle frame components.

20 Claims, 4 Drawing Sheets

APPARATUS FOR PERFORMING A HYDROFORMING OPERATION

BACKGROUND OF THE INVENTION

This invention relates in general to an apparatus for performing a hydroforming operation on a closed channel workpiece. In particular, this invention relates to an improved structure for such a hydroforming apparatus that is relative simple and inexpensive in structure and operation and is well suited for performing a hydroforming operation on relatively long workpieces, such as side rails for a vehicle frame assembly.

Hydroforming is a well known metal working process that uses pressurized fluid to expand a closed channel workpiece, such as a tubular member, outwardly into conformance with a die cavity having a desired shape. A typical hydroforming apparatus includes a frame having a two or more die sections that are supported thereon for relative movement between opened and closed positions. The die sections have cooperating recesses formed therein which together define a die cavity having a shape corresponding to a desired final shape for the workpiece. When moved to the opened position, the die sections are spaced apart from one another to allow a workpiece to be inserted within or removed from the die cavity. When moved to the closed position, the die sections are disposed adjacent to one another so as to enclose the workpiece within the die cavity. Although the die cavity is usually somewhat larger than the workpiece to be hydroformed, movement of the two die sections from the opened position to the closed position may, in some instances, cause some mechanical deformation of the hollow member. In any event, the workpiece is then filled with a fluid, typically a relatively incompressible liquid such as water. The pressure of the fluid within the workpiece is increased to such a magnitude that the workpiece is expanded outwardly into conformance with the die cavity. As a result, the workpiece is deformed into the desired final shape. Hydroforming is an advantageous process for forming vehicle frame components and other structures because it can quickly deform a workpiece into a desired complex shape.

In a typical hydroforming apparatus, the die sections are arranged such that an upper die section is supported on a ram of the apparatus, while a lower die section is supported on a bed of the apparatus. A mechanical or hydraulic actuator is provided for raising the ram and the upper die section upwardly to the opened position relative to the lower die section, allowing the previously deformed workpiece to be removed from and the new workpiece to be inserted within the die cavity. The actuator also lowers the ram and the upper die section downwardly to the closed position relative to the lower die section, allowing the hydroforming process to be performed. To maintain the die sections together during the hydroforming process, a mechanical clamping device is usually provided. The mechanical clamping device mechanically engages the die sections (or, alternatively, the ram and the base upon which the die sections are supported) to prevent them from moving apart from one another during is the hydroforming process. Such movement would obviously be undesirable because the shape of the die cavity would become distorted, resulting in unacceptable variations in the final shape of the workpiece.

As mentioned above, the hydroforming process involves the application of a highly pressurized fluid within the workpiece to cause expansion thereof. The magnitude of the pressure of the fluid within the workpiece will vary according to many factors, one of which being the physical size of the workpiece to be deformed. When a relatively small or thin-walled workpiece is being deformed, the magnitude of the pressure of the fluid supplied within the workpiece during the hydroforming operation is relatively small. Accordingly, the amount of the outwardly-directed force exerted by the workpiece on the die sections during the hydroforming operation is also relatively small. In these instances, only a relatively small amount of inwardly-directed force is required to be exerted by the hydroforming apparatus to counteract the outwardly-directed force so as to maintain the die sections in the closed position during the hydroforming operation. Consequently, the physical size and strength of the hydroforming apparatus when used for deforming relatively small or thin-walled workpieces is no greater than a typical mechanical press for performing a similar operation.

However, when a relatively large or thick-walled workpiece is being deformed (such as is found in many vehicle frame components, including side rails, cross members, and the like), the magnitude of the pressure of the fluid supplied within the workpiece during the hydroforming operation is relatively large. Accordingly, the amount of the outwardly-directed force exerted by the workpiece on the die sections during the hydroforming operation is also relatively large. To counteract this, a relatively large amount of inwardly-directed force is required to be exerted by the hydroforming apparatus to maintain the die sections in the closed position during the hydroforming operation. Consequently, the physical size and strength of the hydroforming apparatus is as large or larger than a typical mechanical press for performing a similar operation. This is particularly troublesome when the workpiece is relatively long, such as found in side rails for vehicle frames. The cost and complexity of manufacturing a conventional hydroforming apparatus which is capable of deforming such a workpiece is very high. Thus, it would be desirable to provide an improved structure for a hydroforming apparatus which is capable of deforming relatively large and thick-walled workpieces, yet which is relatively small, simple, and inexpensive in construction and operation.

SUMMARY OF THE INVENTION

This invention relates to an improved structure for a hydroforming apparatus which is capable of deforming relatively large and thick-walled workpieces, yet which is relatively small, simple, and inexpensive in construction and operation. The hydroforming apparatus includes a pressure vessel that is disposed within a frame. The pressure vessel includes upper and lower vessel members that support respective die sections therein. When the upper and lower vessel members are moved adjacent to one another, the die sections cooperate to define a die cavity in which a workpiece to be hydroformed is disposed. An inflatable bladder is disposed between one or both of the die sections and the associated upper and lower vessel members. During the hydroforming operation, pressurized fluid is introduced within the workpiece so as to expand it outwardly into conformance with the die cavity defined by the die sections. At the same time, pressurized fluid is introduced into the inflatable bladder, causing it to expand between the die sections and the associated upper and lower vessel members. The inflatable bladder allows for limited expansion of the upper and lower vessel members while preventing relative movement between the die sections. As a result, the size, complexity, and cost of the hydroforming apparatus can be maintained at a minimum, while facilitating the hydroforming of relatively large and thick-walled workpieces, such as vehicle frame components.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
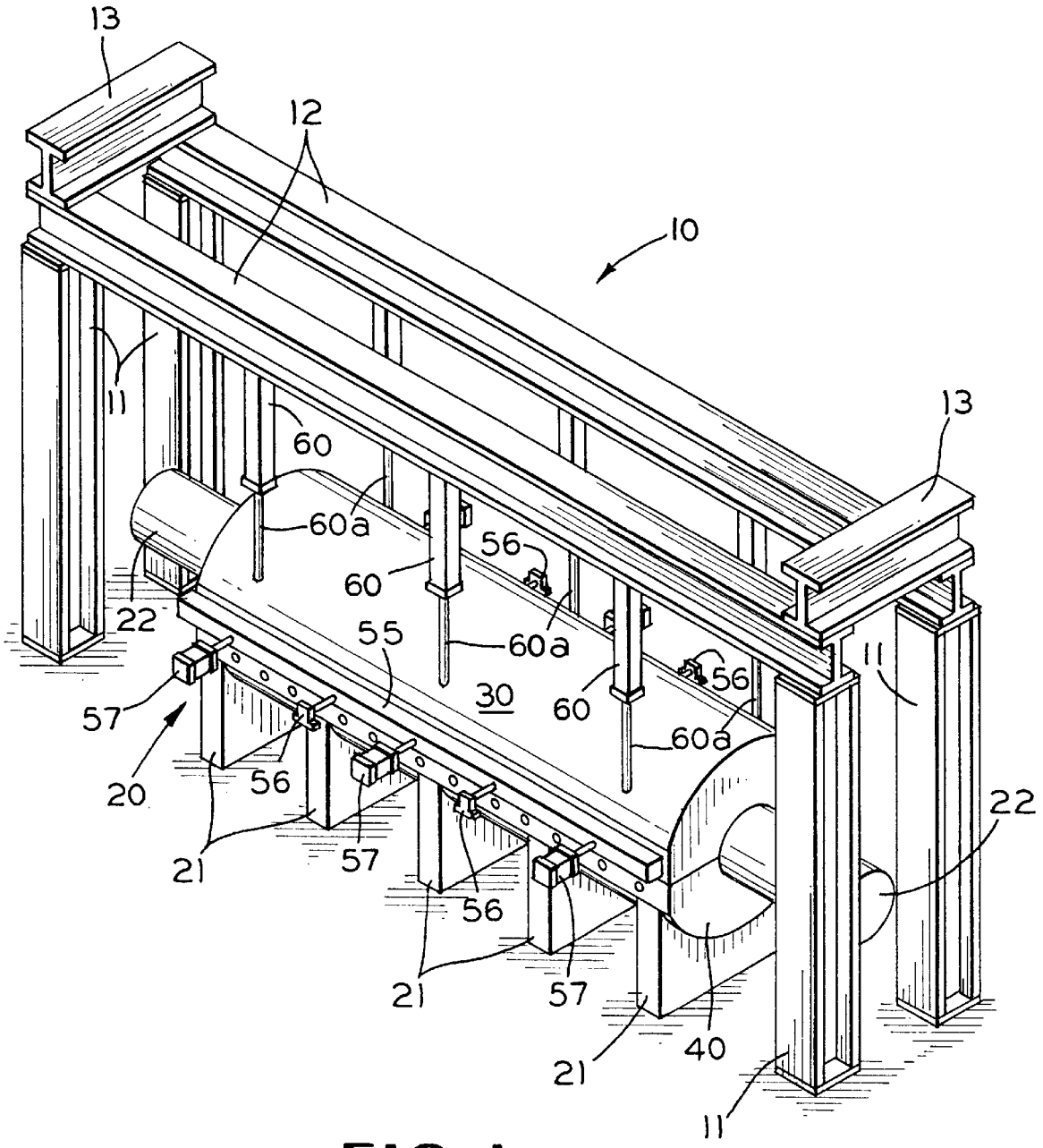
FIG. 1 is a perspective view of a hydroforming apparatus in accordance with this invention.

Referring now to the drawings, there is illustrated in FIGS. 1 through 4 a first embodiment of a hydroforming apparatus, indicated generally at 10, in accordance with this invention. The hydroforming apparatus 10 includes a frame that, in the illustrated embodiment, consists of four uprights 11, a pair of longitudinally extending side beams 12, and a pair of transversely extending cross beams 13. The illustrated uprights 11, side beams 12, and cross beams 13 are embodied as conventional I-beams (although such is not necessary) and are arranged in the shape of a rectangular parallelepiped. However, it will be appreciated that the frame of the hydroforming apparatus 10 may be constructed in any other conventional manner.

Figure 2:
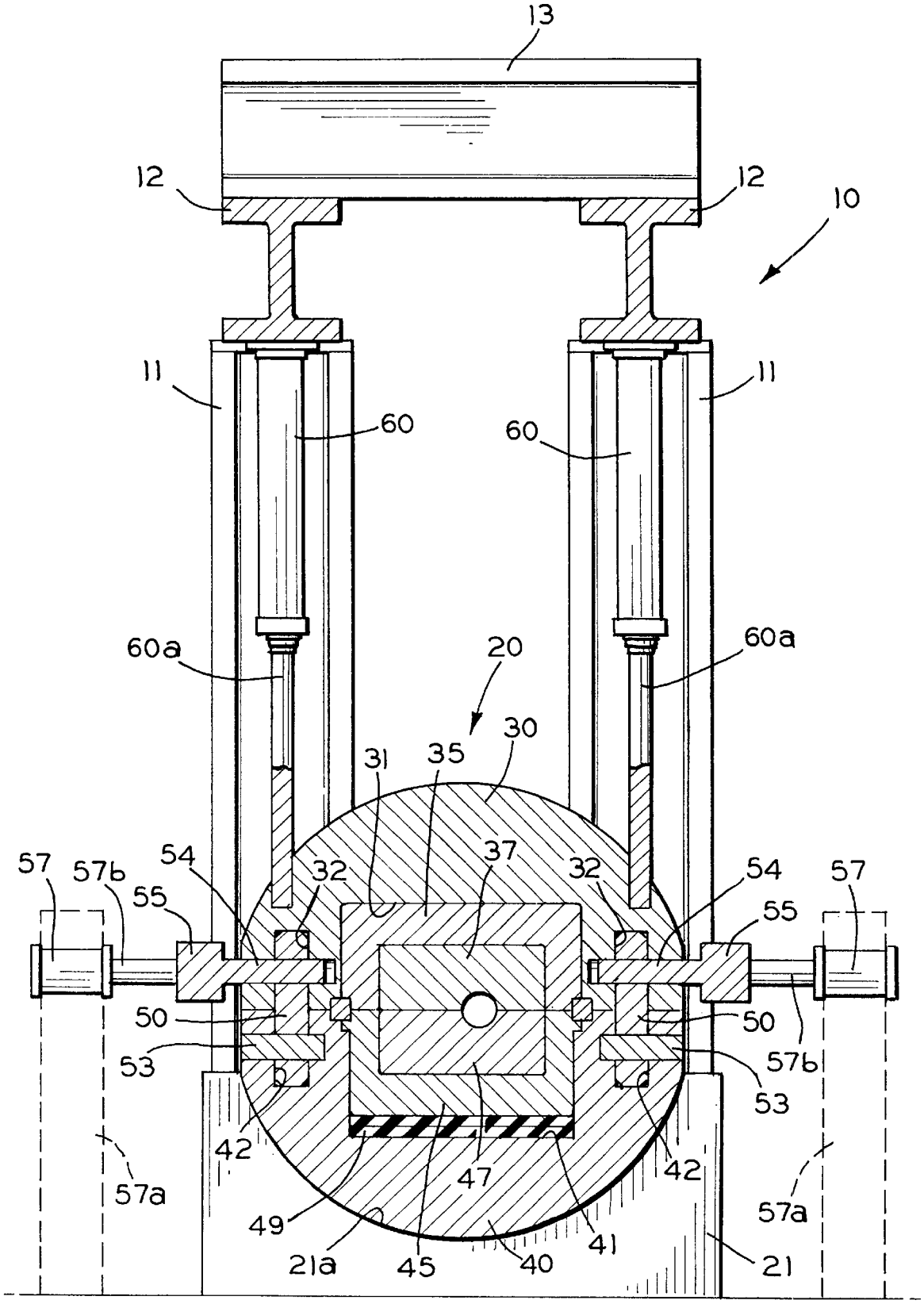
FIG. 2 is an end elevational view, partially in cross section, of the hydroforming apparatus illustrated in FIG. 1.
Figure 3:
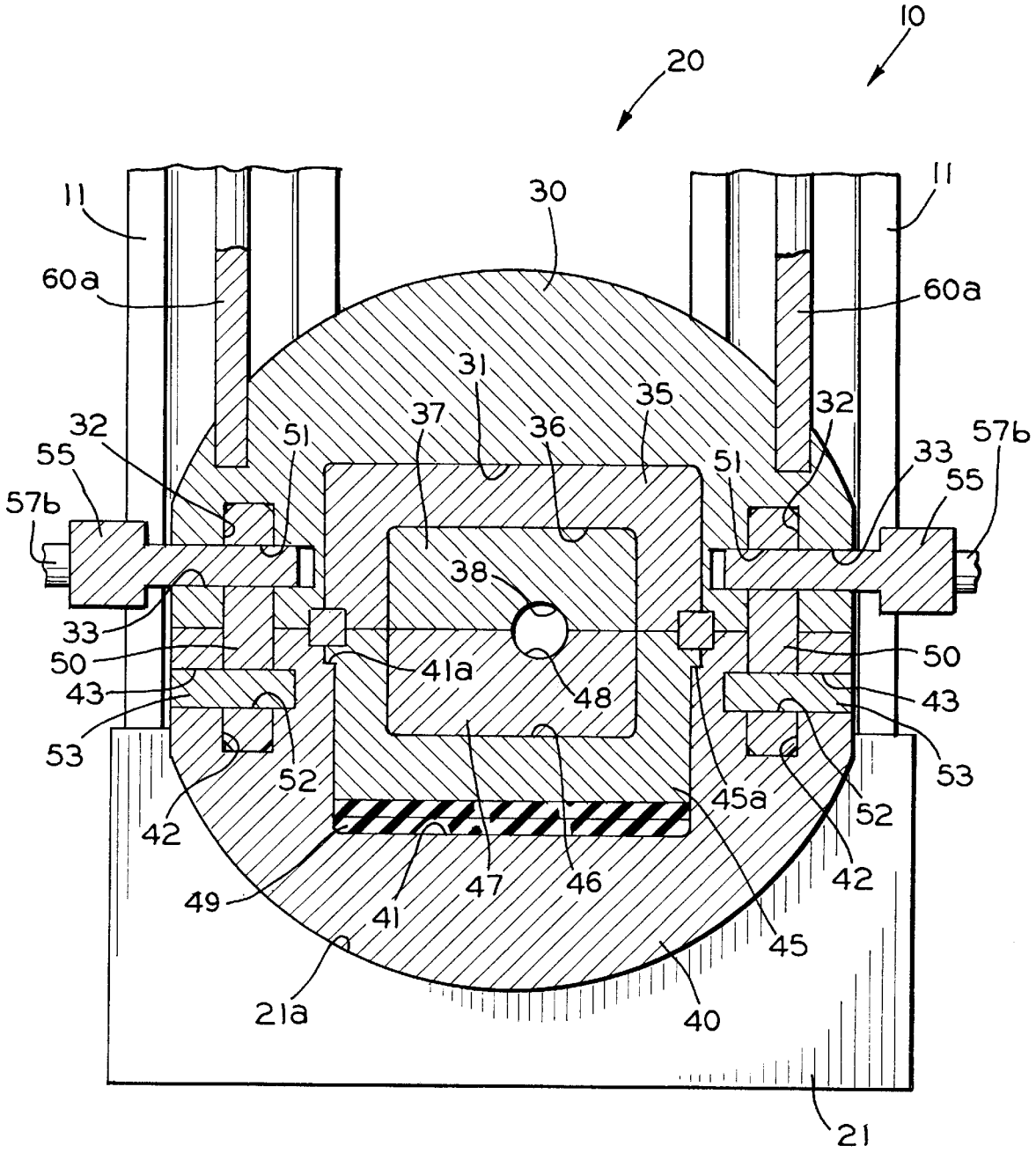
FIG. 3 is an enlarged view of a portion of the hydroforming apparatus illustrated in FIG. 2.

The hydroforming apparatus 10 also includes a pressure vessel, indicated generally at 20, which is disposed within the frame. The pressure vessel 20 is generally cylindrical in shape and extends throughout most of the longitudinal length of the frame 10. A plurality of spaced apart supports 21 are provided for supporting the pressure vessel 20 on a support surface. As best shown in FIGS. 2 and 3, each of the supports 21 has a semi-circular recess 21 a formed in the upper surface thereof for receiving the lower portion of the pressure vessel 20 therein. Although not shown, the supports 21 may be integrated with the frame 10 into a single unit. Regardless, the pressure vessel 20 may be supported relative to the frame 10 in any conventional manner.

The hydroforming apparatus 10 further includes a pair of end feed cylinders 22 that are located at the opposite ends of the pressure vessel 20. The end feed cylinders 22 are conventional in the art and are adapted to engage the ends of a workpiece (not shown) disposed within a die cavity defined within the pressure vessel 20 to perform a hydroforming operation. As is well known, the end feed cylinders 22 are adapted to fill the workpiece with a fluid, typically a relatively incompressible liquid such as water, from a source of pressurized fluid (not shown). The pressure of the fluid within the workpiece is then increased to such a magnitude that the workpiece is expanded outwardly into conformance with the die cavity. Thus, the die cavity is preferably shaped to have a desired final shape for the workpiece.

Referring now to FIGS. 2 and 3, the structure of the pressure vessel 20 is illustrated in detail. As shown therein, the pressure vessel 20 includes an upper vessel member 30 and a lower vessel member 40, both of which are generally semicylindrical in shape. The vessel members 30 and 40 are preferably formed from a strong, rigid material, such as steel. The illustrated vessel members 30 and 40 extend longitudinally throughout the entire length of the pressure vessel 20. However, each of the vessel members 30 and 40 may be divided into a plurality of shorter length segments that are secured together in a conventional manner. By forming the vessel members 30 and 40 in such shorter lengths, the overall size of the pressure vessel 20 may be adjusted to accommodate workpieces of varying length.

Figure 4:
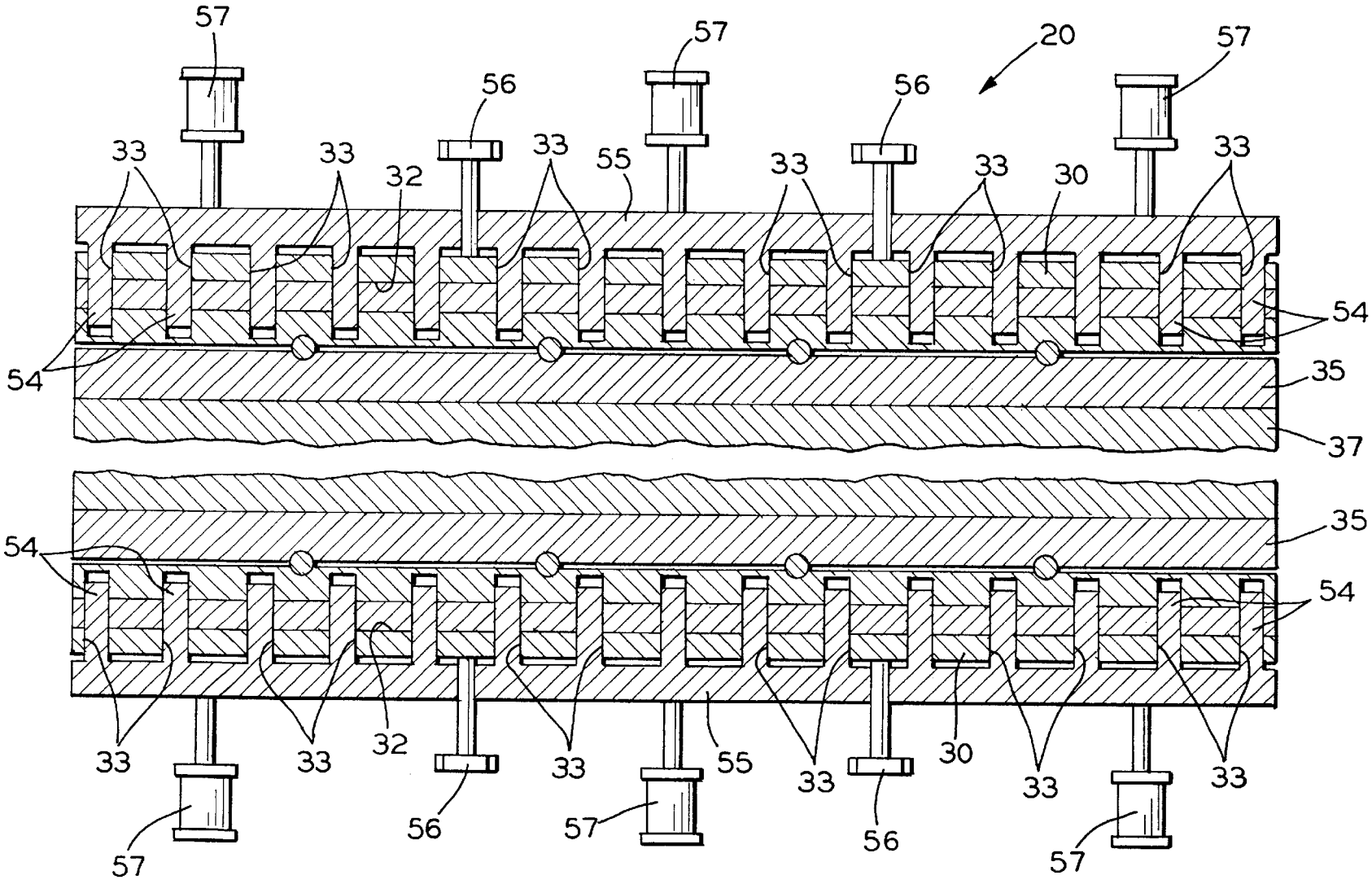
FIG. 4 is a top plan view of the pressure vessel of the hydroforming apparatus illustrated in FIG. 1.

The upper vessel member 30 has a central recess 31 formed therein that extends longitudinally throughout the length thereof. The upper vessel member 30 also has a pair of relatively narrow slots 32 formed near the sides thereof, preferably on opposite sides of the central recess 31. The slots 32 extend longitudinally throughout the length of the upper vessel member 30 and are provided for a purpose that will be explained in detail below. A plurality of transversely extending counterbores 33 are formed in the upper vessel member 30, extending inwardly from each of the sides of the upper vessel member 30. As best shown in FIG. 4, fifteen equidistantly spaced counterbores 33 are formed in each side of the upper vessel member 30. However, it will be appreciated that the number and location of such counterbores 33 may be varied as desired. Each of the counterbores 33 intersects and extends through the slots 32 formed through the upper vessel member 30. The purpose of the counterbores 33 will also be explained in detail below.

An upper tool holder 35 is disposed within the central recess 31 formed in the upper vessel member 30. The upper tool holder 35 has an outer surface that conforms generally in shape to the inner surface of the central recess 31 of the upper vessel member 30. Thus, the upper tool holder 35 may be secured to the upper vessel member 30 in any conventional manner, such as by a plurality of threaded fasteners (not shown). The upper tool holder 35 is formed having a generally U-shaped cross section, defining a recessed area 36. The illustrated upper tool holder 35 extends longitudinally throughout the length of the upper vessel member 30. However, as with the upper vessel member 30, the upper tool holder 35 may be divided into a plurality of shorter length segments that are secured together in a conventional manner. An upper die section or tool insert 37 is disposed within the recessed area 36 formed in the upper tool holder 35. The upper die section 37 has an outer surface that conforms generally in shape to the inner surface of the recessed area 36 of the upper tool holder 35. Thus, the upper die section 37 may be secured to the upper tool holder 35 in any conventional manner, such as by a plurality of threaded fasteners (not shown). The upper die section 37 has a cavity portion 38 formed in the lower surface thereof for a purpose that will be explained in detail below. The upper tool holder 35 and the upper die section 37 are preferably formed from a strong, rigid material, such as steel.

The lower vessel member 40 has a central recess 41 formed therein that extends longitudinally throughout the length thereof. As best shown in FIG. 3, the central recess 41 has a pair of inwardly extending shoulders 41 a formed on the sides thereof, extending longitudinally throughout the length thereof. The purpose of the shoulders 41*a* will be explained in detail below. The lower vessel member 40 also has a pair of relatively narrow slots 42 formed near the sides thereof, preferably on opposite sides of the central recess 41. The slots 42 extend longitudinally throughout the length of the lower vessel member 40 and are provided for a purpose that will be explained in detail below. A plurality of transversely extending counterbores 43 are formed in the lower vessel member 40, extending inwardly from each of the sides of the lower vessel member 40. Similar to the upper vessel member 30 described above, fifteen equidistantly spaced counterbores 43 are formed in each side of the lower vessel member 40. However, it will be appreciated that the number and location of such counterbores 43 may be varied as desired. Each of the counterbores 43 intersects and extends through the slots 42 formed through the lower vessel member 40. The purpose of the counterbores 43 will also be explained in detail below.

A lower tool holder 45 is disposed within the central recess 41 formed in the lower vessel member 40. The lower tool holder 45 has an outer surface that conforms generally in shape to the inner surface of the central recess 41 of the lower vessel member 40. However, as best shown in FIG. 3, the lower tool holder 45 has a pair of outwardly extending shoulders 45*a* formed on the sides thereof, extending longitudinally throughout the length thereof The outwardly extending shoulders 45*a* of the lower tool holder 45 cooperate with the inwardly extending shoulders 41 a formed in the central recess 41 of the lower vessel member 40 to support the lower tool holder 45 on the lower vessel member 40. When so supported, a relatively small, longitudinally extending space is defined between the lower surface of the lower tool holder 45 and the upper surface of the central recess 41 formed in the lower vessel member 40. The purpose of this longitudinally extending space will be explained in detail below.

The lower tool holder 45 is formed having a generally U-shaped cross section, defining a recessed area 46. The illustrated lower tool holder 45 extends longitudinally throughout the length of the lower vessel member 40. However, as with the lower vessel member 40, the lower tool holder 45 may be divided into a plurality of shorter length segments that are secured together in a conventional manner. An lower die section or tool insert 47 is disposed within the recessed area 46 formed in the lower tool holder 45. The lower die section 47 has an outer surface that conforms generally in shape to the inner surface of the recessed area 46 of the lower tool holder 40. Thus, the lower die section 47 may simply rest within the lower tool holder 45 or be secured to the lower tool holder 45 in any conventional manner, such as by a plurality of threaded fasteners (not shown). The lower die section 47 has a cavity portion 48 formed in the upper surface thereof for a purpose that will be explained in detail below. The lower tool holder 45 and the lower die section 47 are preferably formed from a strong, rigid material, such as steel.

When the upper vessel member 30 is located adjacent to the lower vessel member 40 as illustrated in FIGS. 2 and 3, the cavity portions 38 and 48 of the upper and lower die sections 37 and 47, respectively, cooperate to define a die cavity. A representative shape for a die cavity adapted to hydroform an elongated vehicle side rail is shown in FIG. 4. As is well known in the art, the die cavity defines a desired shape for a workpiece to be deformed by hydroforming. As mentioned above, hydroforming is a well known metal working process that uses pressurized fluid to expand a closed channel workpiece, such as a tubular member, outwardly into conformance with the die cavity. Thus, in order to perform a hydroforming operation, the upper vessel member 30 must be moved adjacent to the lower vessel member 40 as illustrated. The upper vessel member 30 is raised above the lower vessel member 40 to allow a workpiece to be inserted within or removed from the die cavity. Although the die cavity is usually somewhat larger than the workpiece to be hydroformed, movement of the upper vessel member 30 to the position illustrated in FIGS. 2 and 3 may, in some instances, cause some mechanical deformation of the workpiece.

As mentioned above, the lower tool holder 45 is supported on the lower vessel member 40 in such a manner as to provide a relatively small, longitudinally extending space between the lower surface of the lower tool holder 45 and the upper surface of the central recess 41 formed in the lower vessel member 40. An inflatable bladder 49 is disposed within this longitudinally extending space. The illustrated bladder 49 is formed from a fluid-tight flexible material, such as rubber or other elastomeric material. However, as will be explained in detail below, the bladder 49 may be formed in any shape and from any material so as to be capable of physical expansion in response to the application of pressurized fluid therein. The purpose for the bladder 49 will be explained in detail below.

The pressure vessel 20 includes a locking structure for selectively securing the upper vessel member 30 to the lower vessel member 40 to permit a hydroforming operation to be performed. The illustrated locking structure includes a pair of locking bars 50. As best shown in FIG. 3, the upper portions of the locking bars 50 are disposed within the slots 32 formed in the upper vessel member 30, while the lower portions of the locking bars 50 are disposed within the slots 42 formed in the lower vessel member 40. Each of the locking bars 50 extends longitudinally throughout the lengths of the upper and lower vessel members 30 and 40, as shown in FIG. 4. An upper plurality of apertures 51 is formed through the upper portions of each of the locking bars 50. The upper apertures 51 correspond in size, shape, and location to the counterbores 33 formed in the upper vessel member 30. Similarly, a lower plurality of apertures 52 is formed through the lower portions of each of the locking bars 50. The lower apertures 52 correspond in size, shape, and location to the counterbores 43 formed in the lower vessel member 40.

The locking structure also includes a mechanism for securing the lower portions of the locking bars 50 to the lower vessel member 40. In the illustrated embodiment, this mechanism includes a plurality of fixed pins 53 that are disposed within each of the counterbores 43 formed in the lower vessel member 40. As mentioned above, each of the counterbores 43 intersects and extends through the slots 42 formed through the lower vessel member 40. Thus, as shown in FIGS. 3 and 4, the fixed pins 53 extend through both the counterbores 43 and the lower apertures 52 formed through the locking bars 50. In this manner, the lower portions of the locking bars 50 are securely fastened to the lower vessel member 40. In the illustrated embodiment, the fixed pins 53 are not intended to be readily removable from the lower vessel member 40. Thus, the fixed pins 53 can be press fit or otherwise retained within the counterbores 43. However, it will be appreciated that the fixed pins 53 can be altered to facilitate the removal thereof if desired. Notwithstanding the above, it will be appreciated that any other conventional structure may be used to retain the locking bars 50 on the lower vessel member 40.

The locking structure further includes a mechanism for releasably securing the upper portions of the locking bars 50 to the upper vessel member 30. In the illustrated embodiment, this mechanism includes a plurality of movable pins 54 that are disposed within each of the counterbores 33 formed in the upper vessel member 30. As mentioned above, each of the counterbores 33 intersects and extends through the slots 32 formed through the upper vessel member 30. Thus, as shown in FIGS. 3 and 4, the movable pins 54 extend through both the counterbores 33 and the upper apertures 51 formed through the locking bars 50. In this manner, the upper portions of the locking bars 50 can be securely fastened to the upper vessel member 30. In the illustrated embodiment, the movable pins 54 are intended to be readily removable from the upper vessel member 30. To accomplish this, the movable pins 54 are secured to a pair of header bars 55 that extend longitudinally along the opposed sides of the pressure vessel 20. Thus, when the header bars 55 are moved outwardly away from the sides of the pressure vessel 20, the movable pins 54 are moved out of the upper apertures 51 formed through the locking bars 50. In this manner, the upper vessel member 30 can be released from the locking bars 50 and, consequently, the lower vessel member 40. The movable pins 54 are shown in FIGS. 3 and 4 as being formed integrally with the header bars 55. However, the movable pins 54 may be formed separately from the header bars 55 or, alternatively, may be formed as independently movable members that can be individually moved into and out of engagement with the locking bars 50. Notwithstanding the above, it will be appreciated that any other conventional structure may be used to retain the locking bars 50 on the lower vessel member 40.

In the illustrated embodiment, a plurality of slides 56 are provided for supporting the header bars 55 (and, thus, the movable pins 54) for sliding movement between a locked position, wherein the upper vessel member 30 is secured to the lower vessel member 40, and an unlocked position, wherein the upper vessel member 30 is secured to the lower vessel member 40. As best shown in FIG. 4, each of the slides 56 includes a shaft portion that is secured to the outer surface of the upper vessel member 30 and extends through respective slide apertures 56*a* formed through the header bars 55. Each of the slides 56 further includes an enlarged head portion which limits the outward movement of the header bars 55 away from the opposed sides of the pressure vessel 20. The slides 56 are designed to support the weight of the header bars 55 on the upper vessel member 30 so as to allow free sliding movement thereof. It will be appreciated, however, that any other conventional structure may be provided for supporting the header bars 55 for sliding movement between the locked and unlocked positions.

In the illustrated embodiment, a plurality of hydraulic cylinders 57 is provided to effect movement of the header bars 55 (and, thus, the movable pins 54) between the locked position and the unlocked position. The body portions of the hydraulic cylinders 57 are mounted on respective fixed supports illustrated in dotted lines at 57*a* in FIG. 3. Movable rod portions 57*b* extend outwardly from the body portions and are secured to the header bars 55. The hydraulic cylinders 57 are connected through conventional valves (not shown) to a source of pressurized fluid. In a manner that is well known in the art, the valves can be actuated so as to cause the rod portions 57*b* to be extended from the hydraulic cylinders 57, thereby moving the header bars 55 and the movable pins 54 inwardly to the locked position illustrated in FIGS. 2, 3, and 4. Similarly, the valves can be actuated so as to cause the rod portions 57*b* to be retracted within the hydraulic cylinders 57, thereby moving the header bars 55 and the movable pins 54 outwardly to the unlocked position. Preferably, the valves are actuated by solenoids, and an electronic control circuit is provided to effect the operation of the hydraulic cylinders 57. However, it will be appreciated that any conventional structure may be provided to effect movement of the header bars 55 and the movable pins 54 between the locked position and the unlocked position.

The hydroforming apparatus 10 further includes a mechanism for selectively raising and lowering the upper vessel member 30 relative to the lower vessel member 40. In the illustrated embodiment, this raising and lowering mechanism includes a plurality of hydraulic cylinders 60. As best shown in FIG. 2, the body portions of the hydraulic cylinders 60 are secured to the lower surfaces of the longitudinally extending side beams 12, extending downwardly therefrom. Movable rod portions 60*a* of the hydraulic cylinders 60 extend outwardly from the body portions and are secured to the upper vessel member 30 in any conventional manner. The hydraulic cylinders 60 are connected through conventional valves (not shown) to a source of pressurized fluid. In a manner that is well known in the art, the valves can be actuated as to cause the rod portions 60*a* to be extended from the hydraulic cylinders 60, thereby lowering the upper vessel member 30 downwardly into engagement with the lower vessel member 40, as shown in FIGS. 1, 2, and 3. Similarly, the valves can be actuated so as to cause the rod portions 60*a* to be retracted within the hydraulic cylinders 60, thereby raising the upper vessel member 30 above the lower vessel member 40. Preferably, the valves are actuated by solenoids, and an electronic control circuit is provided to effect the operation of the hydraulic cylinders 60. However, it will be appreciated that any conventional structure may be provided to effect movement of the upper vessel member 30 relative to the lower vessel member 40.

The operation of the hydroforming apparatus 10 will now be described. Initially, the hydraulic cylinders 60 are actuated to raise the upper vessel member 30 relative to the lower vessel member 40. As discussed above, the raising of the upper vessel member 30 allows a workpiece to be disposed within cavity portion 48 formed in the upper surface of the lower die section 47. As is known in the art, the workpiece may be preliminarily deformed in a conventional tube bending apparatus so as to possess the general shape of the die cavity. In any event, the hydraulic cylinders 60 are then actuated to lower the upper vessel member 30 into abutment with the lower vessel member 40, as shown in FIGS. 2 and 3. Although the die cavity defined by the upper die section 37 and the lower die section 47 is usually somewhat larger than the workpiece to be hydroformed, movement of the two die sections 37 and 47 from the opened position to the closed position may, in some instances, cause some mechanical deformation of the workpiece.

In any event, once the upper vessel member 30 is disposed adjacent to the lower vessel member 40, the locking mechanism is actuated to securely fasten the upper vessel member 30 to the lower vessel member 40. This is accomplished by actuating the hydraulic cylinders 57 to move the header bars 55 from the unlocked position to the locked position. As discussed above, such movement of the header bars 55 causes the movable pins 54 to extend into the counterbores 33 formed in the upper vessel member 30 and the upper apertures 51 formed through the locking bars 50. As a result, the upper vessel member 30 is securely fastened to the lower vessel member 40.

Next, the end feed cylinders 22 are then actuated to engage the ends of the workpiece and fill the workpiece with a relatively incompressible liquid, such as water. The pressure of the fluid within the workpiece is increased by a conventional intensifier or other conventional portion of the source of pressurized fluid to such a magnitude that the workpiece is expanded outwardly into conformance with the die cavity defined by the cooperating cavity portions 38 and 48. As a result, the workpiece is deformed into the desired final shape.

Because the hydroforming process involves the application of a highly pressurized fluid within the workpiece to cause expansion thereof, the workpiece exerts an outwardly directed force against the die sections 37 and 47 during the hydroforming operation. This outwardly directed force is, in turn, applied through the upper and lower tool holders 35 and 45 to the upper and lower vessel members 30 and 40. The magnitude of this force will vary according to many factors, one of which being the physical size of the workpiece to be deformed. When a relatively large or thick-walled workpiece is being deformed (such as is the case when hydroforming many vehicle frame components), the magnitude of this force is relatively large. As a result, portions of the upper and lower vessel members 30 and 40 may be deflected outwardly under the influence of this force. Such deflections would obviously be undesirable because they might allow relative movement to occur between the cooperating upper and lower die sections 37 and 47, respectively. As discussed above, the conventional approach to preventing such deflections is to increase the physical size of the hydroforming machine, with the attendant increased cost and complexity.

The hydroforming apparatus 10 of this invention does not prevent such deflections from occurring in the upper and lower vessel members 30 and 40. Rather, the hydroforming apparatus 10 of this invention relies upon the inflatable bladder 49 to generate an inwardly directed force against the upper and lower die sections 37 and 47, respectively, to maintain them in position during the hydroforming operation. To accomplish this, the inflatable bladder 49 is pressurized prior to and/or during the hydroforming operation. As discussed above, the inflatable bladder 49 is designed to be capable of physical expansion in response to the application of pressurized fluid therein. The inflatable bladder 49 may be connected to the same source of pressurized fluid as the end feed cylinders 22 such that the same pressurized fluid that is supplied to the interior of the workpiece is also supplied within the inflatable bladder 49. Alternatively, pressurized fluid may be supplied within the inflatable bladder 49 from an independent source. The supply of such pressurized fluid within the inflatable bladder 49 may be controlled by conventional valves (not shown), and the operation of such valves may be controlled by a conventional control system (not shown), including the electronic control circuit provided for automatically operating the hydroforming apparatus 10 as described above.

In any event, the application of pressurized fluid within the inflatable bladder 49 causes physical expansion thereof. As a result of such physical expansion, the inflated bladder 49 reacts between the lower tool holder 45 and the lower vessel member 40, exerting a force to urge them apart from one another. The magnitude of this force is preferably selected to be approximately equal to the magnitude of the outwardly directed force exerted by the workpiece against the lower die section 47 and, thus, the lower tool holder 45. So long as the outwardly directed force generated by expansion of the workpiece is approximately equal to the inwardly directed force generated by the expansion of the inflated bladder 49, the effective force exerted against the lower die section 47 tending to move it relative to the upper die section 37 will be minimized. As a result, the lower die section 47 will remain in position relative to the upper die section 37 during the hydroforming operation, even though portions of the upper and lower vessel members 30 and 40 may be deflected. In effect, the inflatable bladder 49 pre-stresses the upper and lower vessel members 30 and 40 and fills any extra space created by the deflections of portions of such vessel members 30 and 40, thereby retaining the die sections 37 and 47 in position during the hydroforming operation.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A pressure vessel for use in a hydroforming apparatus comprising: first and second vessel members;

first and second die sections respectively supported within said first and second vessel members, said first and second die sections having respective cavity portions formed therein that cooperate to define a die cavity adapted to receive a workpiece therein; and a bladder disposed between said first vessel member and said first die section, said bladder adapted to exert a force against said first vessel member for urging said first vessel member into engagement with said second vessel member.

2. The pressure vessel defined in claim 1 further including a pair of end feed cylinders, each feed cylinder being located at opposite ends of said pressure vessel.

3. The pressure vessel defined in claim 1 further including means for selectively raising and lowering one of said first and second vessel members relative to the other one of said first and second vessel members.

4. The pressure vessel defined in claim 3 wherein said raising and lowering means comprises a plurality of hydraulic cylinders operatively connected to one of said first and second vessel members.

5. The pressure vessel defined in claim 1 wherein one of said first and second vessel members includes a pair of slots formed near the sides thereof, and a plurality of transversely extending counterbores formed therein extending inwardly from each of the sides thereof.

6. The pressure vessel defined in claim 1 further comprising a locking structure for selectively securing said first and second vessel members together.

7. The pressure vessel defined in claim 6 wherein said locking structure comprises a pair of locking bars, each locking bar having an first and second portion, the first portion of each locking bar being disposed within a slot formed in one of said first and second vessel members, and the second portion of each locking bar being disposed within a slot formed in the other one of said first and second vessel members.

8. The pressure vessel defined in claim 7 further comprising a plurality of fixed pins for passing through a first aperture in the first portion of each locking bar, thereby securing the first portion of each locking bar to one of said first and second vessel members.

9. The pressure vessel defined in claim 8 further comprising a plurality of movable pins for passing through a second aperture in the second portion of each locking bar, thereby securing the second portion of each locking bar to the other one of said first and second vessel members.

10. The pressure vessel defined in claim 9 wherein said plurality of movable pins are secured to a pair of header bars extending longitudinally from the sides of said pressure vessel.

11. The pressure vessel defined in claim 10 further comprising a plurality of hydraulic cylinders to effect movement of said pair of header bars between a locked and an unlocked position.

12. A hydroforming apparatus comprising:

first and second vessel members;

first and second die sections respectively supported within said first and second vessel members, said first and second die sections having respective cavity portions formed therein that cooperate to define a die cavity adapted to receive a workpiece therein;

a bladder disposed between said first vessel member and said first die section; and a source of pressurized fluid adapted to communicate with the workpiece to supply pressurized fluid therein to deform the workpiece into conformance with said die cavity, said source of pressurized fluid communicating with said bladder to supply pressurized fluid therein to exert a force against said first vessel member for urging said first vessel member into engagement with said second vessel member.

13. The hydroforming apparatus defined in claim 12 further including a locking structure for selectively locking said first and second vessel members.

14. The hydroforming apparatus defined in claim 13 wherein said locking structure includes a pair of locking bars, each locking bar having an first and second portion, the first portion of each locking bar being disposed within a slot formed in one of said first and second vessel members, and the second portion of each locking bar being disposed within a slot formed in the other one of said first and second vessel members.

15. The hydroforming apparatus defined in claim 14 further comprising a plurality of fixed pins for passing through a first aperture in the first portion of each locking bar, thereby securing the first portion of each locking bar to one of said first and second vessel members.

16. The hydroforming apparatus defined in claim 15 further comprising a plurality of movable pins for passing through a second aperture in the second portion of each locking bar, thereby securing the second portion of each locking bar to the other one of said first and second vessel members.

17. The hydroforming apparatus defined in claim 16 wherein said plurality of movable pins are secured to a pair of header bars extending longitudinally from the sides of said pressure vessel.

18. The hydroforming apparatus defined in claim 17 further comprising a plurality of hydraulic cylinders to effect movement of said pair of header bars between a locked and an unlocked position.

19. The hydroforming apparatus defined in claim 12 further comprising a plurality of hydraulic cylinders operatively connected to one of said first and second vessel members for raising and lowering one of said first and second vessel members relative the other one of said first and second vessel members.

20. A pressure vessel for a hydroforming apparatus comprising:

first and second vessel members;

first and second die sections respectively supported within said first and second vessel members, said first and second die sections having respective cavity portions formed therein that cooperate to define a die cavity adapted to receive a workpiece therein;

a locking structure for selectively locking said first and second vessel members, and an inflatable bladder disposed between one of said first and second vessel members and the respective one of said first and second die sections.

* * * * *